US009284735B2

(12) United States Patent
Bryer et al.

(10) Patent No.: US 9,284,735 B2
(45) Date of Patent: Mar. 15, 2016

(54) DEBRIS REPELLING FILTERING DEVICE FOR ROOF GUTTERS

(71) Applicants: Slate E. Bryer, Rocklin, CA (US); Lawrence B. Dumm, Roseville, CA (US); Christopher G. Tatasciore, Loomis, CA (US)

(72) Inventors: Slate E. Bryer, Rocklin, CA (US); Lawrence B. Dumm, Roseville, CA (US); Christopher G. Tatasciore, Loomis, CA (US)

( * ) Notice: Subject to any disclaimer, the term of this patent is extended or adjusted under 35 U.S.C. 154(b) by 0 days.

(21) Appl. No.: 14/461,447

(22) Filed: Aug. 18, 2014

(65) Prior Publication Data

US 2015/0225960 A1 Aug. 13, 2015

Related U.S. Application Data

(60) Provisional application No. 61/867,319, filed on Aug. 19, 2013.

(51) Int. Cl.
*E04D 13/00* (2006.01)
*E04D 13/076* (2006.01)

(52) U.S. Cl.
CPC ..... *E04D 13/0767* (2013.01); *E04D 13/076* (2013.01)

(58) Field of Classification Search
CPC ..... E04D 13/0762; E04D 13/076
USPC ..... 52/12, 11, 14
See application file for complete search history.

(56) References Cited

U.S. PATENT DOCUMENTS

| | | | | | |
|---|---|---|---|---|---|
| 546,042 | A * | 9/1895 | Horn | 52/12 |
| 2,583,422 | A * | 1/1952 | Haddon | 210/498 |
| 2,674,961 | A * | 4/1954 | Lake | 210/474 |
| 3,950,951 | A * | 4/1976 | Zukauskas | 405/119 |
| 4,745,710 | A * | 5/1988 | Davis | 52/12 |
| 4,959,932 | A * | 10/1990 | Pfeifer | 52/12 |
| 8,572,899 | B1 * | 11/2013 | Pearce et al. | 52/12 |
| 2005/0097826 | A1 * | 5/2005 | Fox | 52/12 |
| 2005/0247611 | A1 * | 11/2005 | Groth et al. | 210/162 |
| 2006/0123710 | A1 * | 6/2006 | Lenney et al. | 52/12 |
| 2007/0214731 | A1 * | 9/2007 | Bachman et al. | 52/12 |
| 2007/0234647 | A1 * | 10/2007 | Higginbotham | 52/12 |
| 2009/0090067 | A1 * | 4/2009 | Demartini | 52/12 |
| 2009/0320381 | A1 * | 12/2009 | Gerig | 52/12 |
| 2010/0287846 | A1 * | 11/2010 | Lenney | 52/12 |
| 2011/0056145 | A1 * | 3/2011 | Lenney et al. | 52/12 |
| 2011/0067317 | A1 * | 3/2011 | Hedrick | 52/12 |
| 2013/0160377 | A1 * | 6/2013 | Sager | 52/12 |
| 2013/0160378 | A1 * | 6/2013 | Higginbotham | 52/12 |

* cited by examiner

*Primary Examiner* — Basil Katcheves

(57) ABSTRACT

A gutter filtering device constructed to be mounted on top of a gutter opening and to extend from the front to the rear, and to attach to the front lip of the gutter. The gutter filtering device comprises a main body frame portion supporting a filtering media, a front mounting portion and a rear wing mounting portion. The main body frame portion is comprised of louvers that supports and holds a filtering media. The front mounting portion comprises a bending of the main body frame that folds over and crimps to the front end of the filtering media. The rear mounting portion comprises a separate rear wing folded over and crimpled to rear portion of the main body frame. The filtering media's top surface is shaped with many front to rear raised ridges in an repeating S-shape pattern that are parallel and form a consistent pattern from left to right.

2 Claims, 5 Drawing Sheets

DEBRIS REPELLING FILTERING DEVICE FOR ROOF GUTTERS

CROSS-REFERENCE TO RELATED APPLICATIONS

This application claims the benefit under 35 U.S.C. under §119(e), to Provisional application number U.S. 61/867,319, filed on Aug. 19, 2013, which is incorporated by reference in its entirety and made part of this specification.

BACKGROUND OF THE INVENTION

This invention relates to a water filtering device that fits over roof rain gutters, also known as gutter guards, that repels debris from entering the gutter while at the same time allowing rainwater to pass through the filter therefore preventing the gutter to become blocked.

Roof gutters or eaves troughs are narrow channels used to collect rainwater shed by roof systems in order to move the rainwater to a downspout for the purpose of either diverting the rainwater away from the structures' foundation to avoid water erosion and water damage, or to collect the rainwater for water harvesting. Generally, there are four categories of roof gutter guards; 1) devices that fit inside a gutter to prevent the blockage of water by the debris, 2) devices that fit over the gutter as with large holes (commonly referred to as screens or diamond hole or drilled hole devices) to block debris and allow water to flow through, 3) devices that fit over gutters with a solid cover and slots allowing debris to fall off while water surface tension pulls the water through a front slot, 4) devices that fit over the gutter with small holes (referred to as mesh or micromesh systems) to block debris and allow water to be pulled through by surface tension devices.

Regarding the mesh filtering type of roof gutter guard, the filtering material holes can be small enough to not allow water to pass freely through due to water's surface tension properties and molecular adhesion forces. Therefore to allow water to be pulled through the filtering material, the use of surface tension devices that touch or designed into the filtering mesh are used while still keeping out debris and leaves. Two such examples of prior art of a small hole filtering devices are U.S. Pat. No. 7,310,912 incorporated herein by reference, and U.S. Pat. No. 6,951,077 B1 incorporated herein by reference.

There exists unlimited combinations of roof types, roof styles, roof slopes, gutter types, gutter sizes, gutter guard materials, rainwater downpour rates, leaf sizes and shapes, debris sizes and shapes, and weather severity to name a good portion of factors that affect a gutter guard's performance. With known prior art on mesh based gutter guards, commonly used techniques to pull or draw water through the mesh utilizing frame rails, mesh designs, or material strips that touch the mesh from underneath that causes the surface tension and adhesion forces to be reduced which allows the water to be drawn through the mesh into the gutter.

There exists undesirable conditions with the current prior art on mesh based gutter guards which are 1. The mesh does a poor job in capturing the water during high flow conditions (like heavy rainfall and high pitch roof systems), 2. The support frames that suspend the mesh from underneath require holes or channels in greater size to allow water to pass thereby weakening the frame and causing it to bend, 3. The support frames contain horizontal surfaces that hold water and moisture that promote moss and algae growth which can cause blockage of the filtering mesh and therefore water runoff.

The present invention is a debris repelling filtering device (also known as a gutter guard) that provides improvements on existing prior art and associated products by 1) reducing the filtering media's water's tension and adhesion properties, 2) improved debris repelling technology, 3) improving frame strength and performance, 4) reducing moss and algae growth conditions, and 5) increased installation adaptability.

BRIEF DESCRIPTION OF THE SEVERAL VIEWS OF THE DRAWING

FIG. 5 B is a front view detail of the filtering media's raised ridge with an angled slope of the side wall.

FIG. 5 C is a front view detail of the filtering media's raised ridge with a vertical slope of the side wall.

FIG. 5 D is a front view detail of the filtering media raised ridge with a narrow distance between the raised ridges.

FIG. 5 E a is a front view detail of the filtering media raised ridge with a wide distance between the raised ridges.

FIG. 9 B is a complete side view of the present invention.

DETAILED DESCRIPTION OF THE INVENTION

Figure 1:
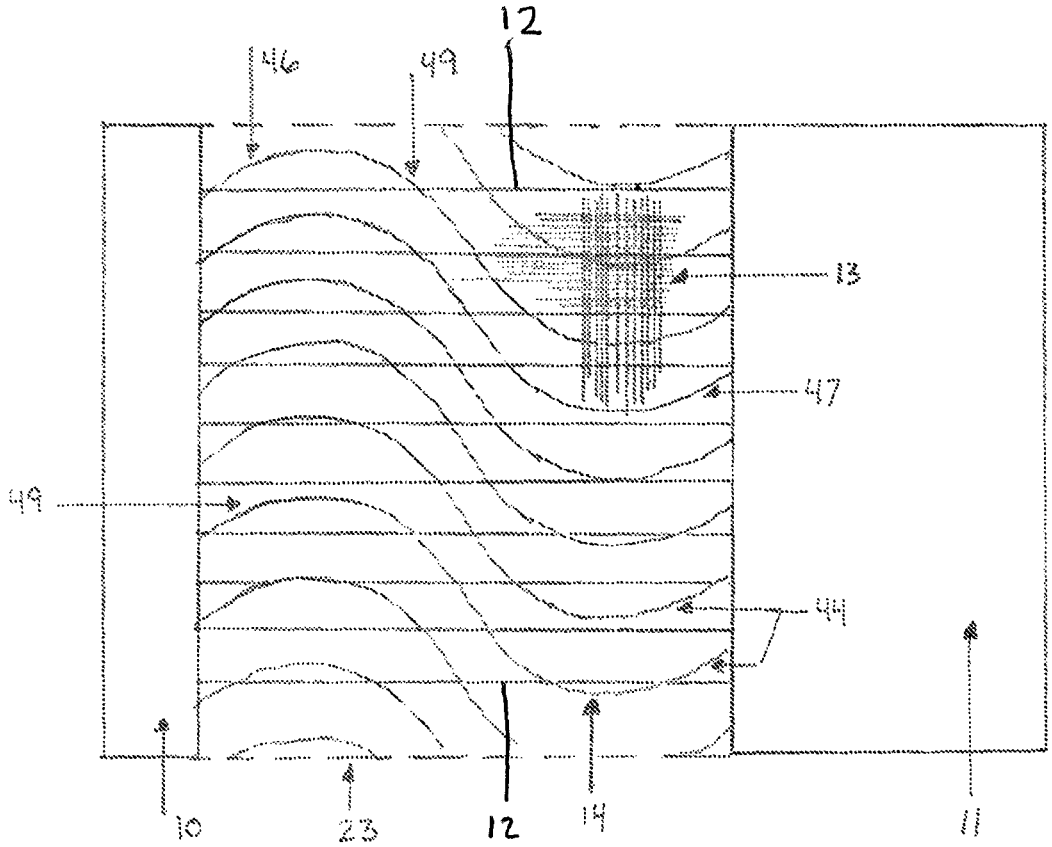
FIG. 1 is a top down elevation view of the present invention.
Figure 2:
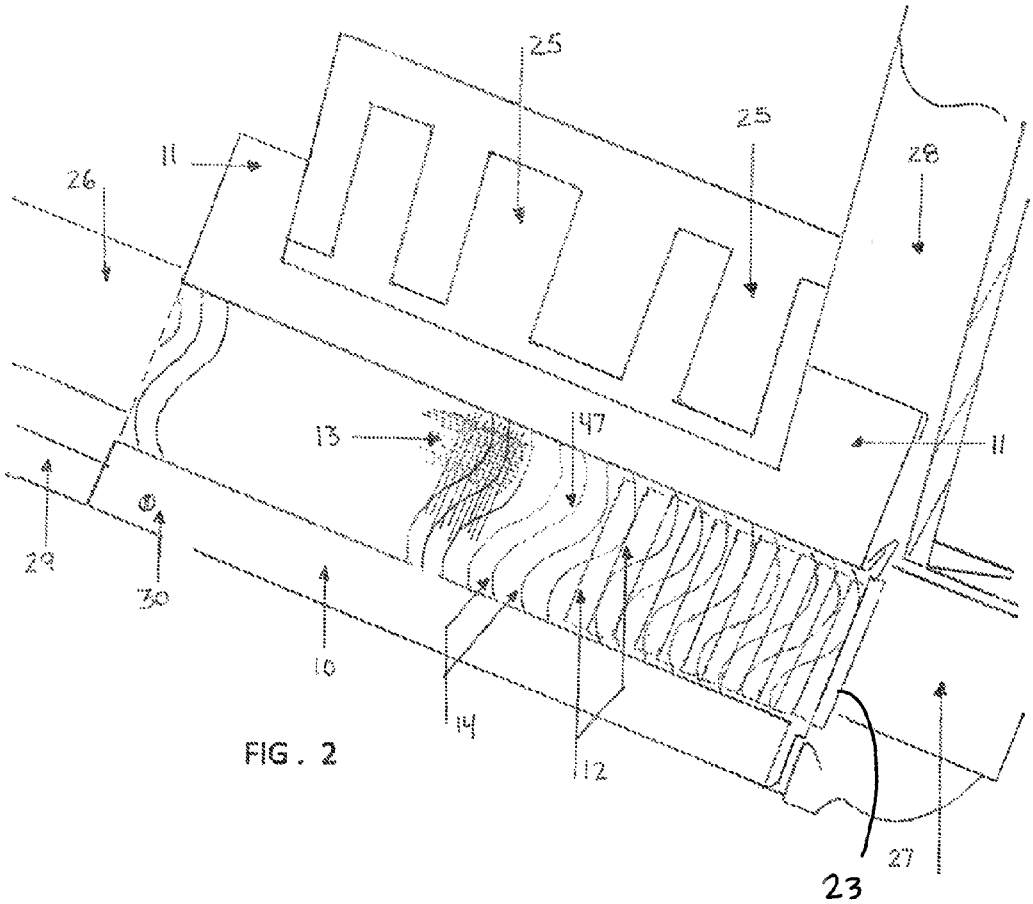
FIG. 2 is a top angle view of a portion of the present invention as installed on as installed on a gutter and roof system.
Figure 3:
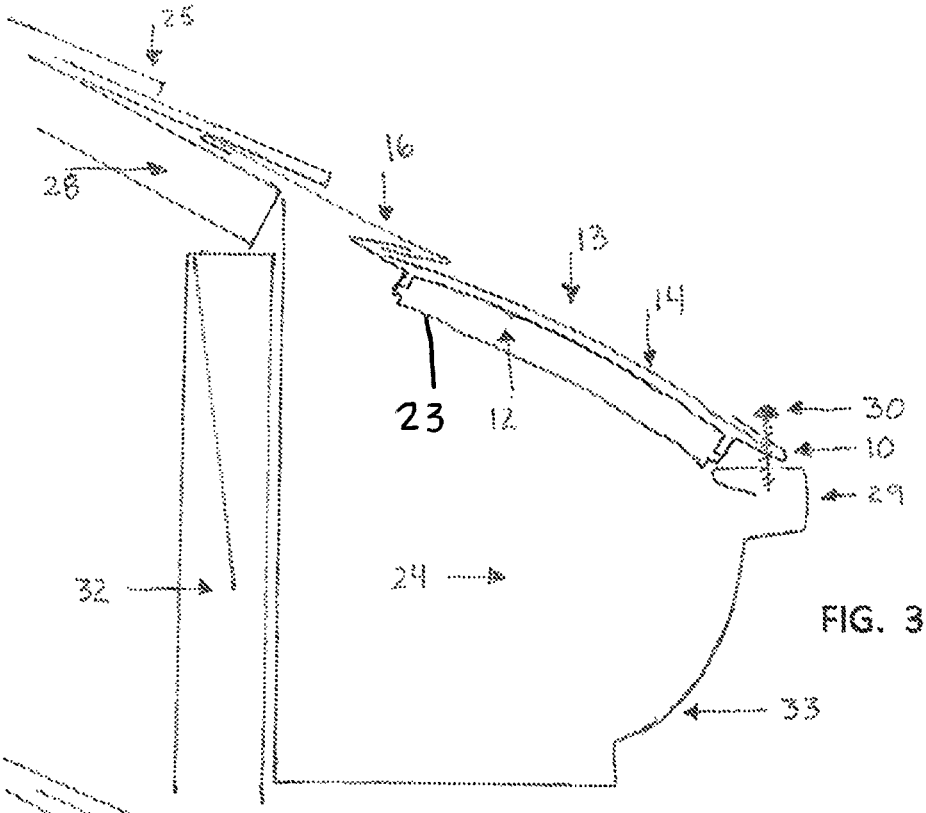
FIG. 3 is a side view of the present invention using the flat wing as installed on gutter.
Figure 4:
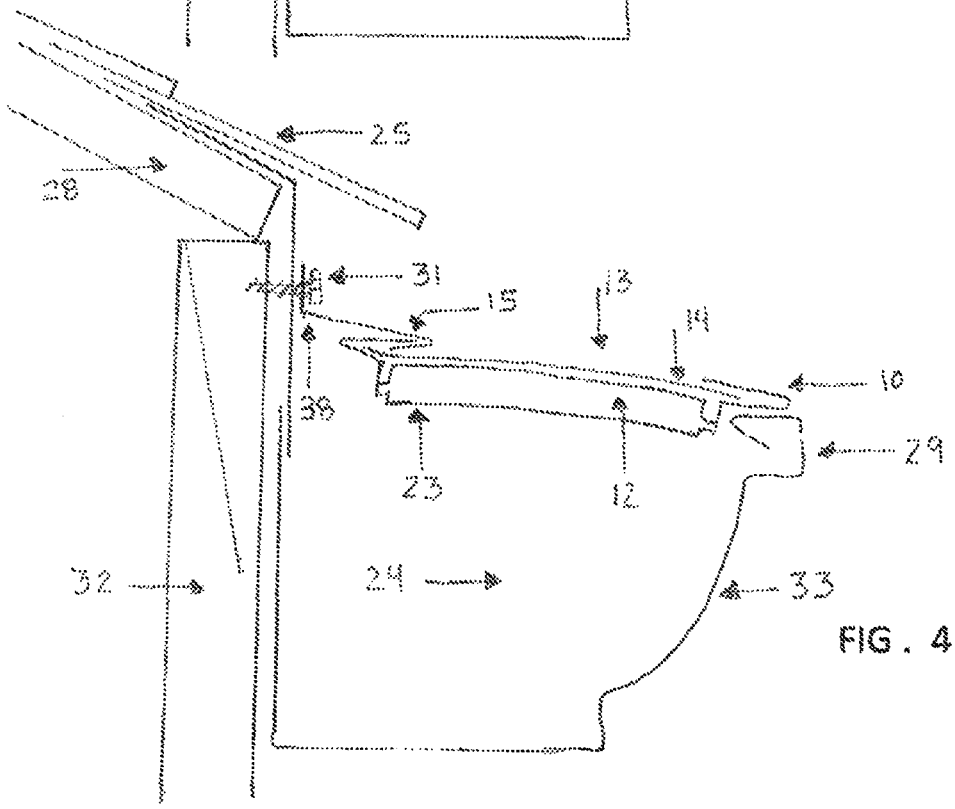
FIG. 4 is a side view of the present invention using the bend wing as installed on gutter.
Figure 5A:
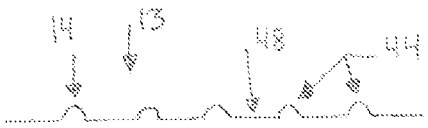
FIG. 5 A is a front view detail on the filtering media raised ridges of present invention.
Figure 5B:
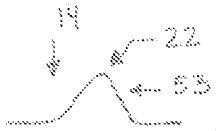
Figure 5C:
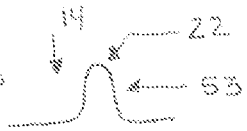
Figure 5D:
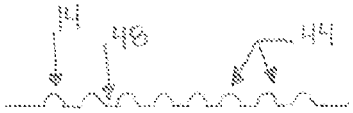
Figure 5E:
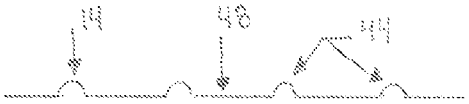
Figure 6:
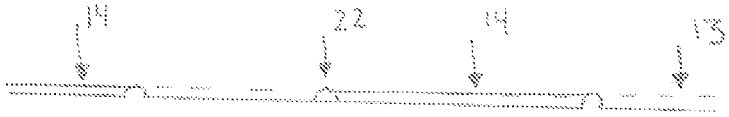
FIG. 6 is a side view of the filtering media of present invention.
Figure 7:
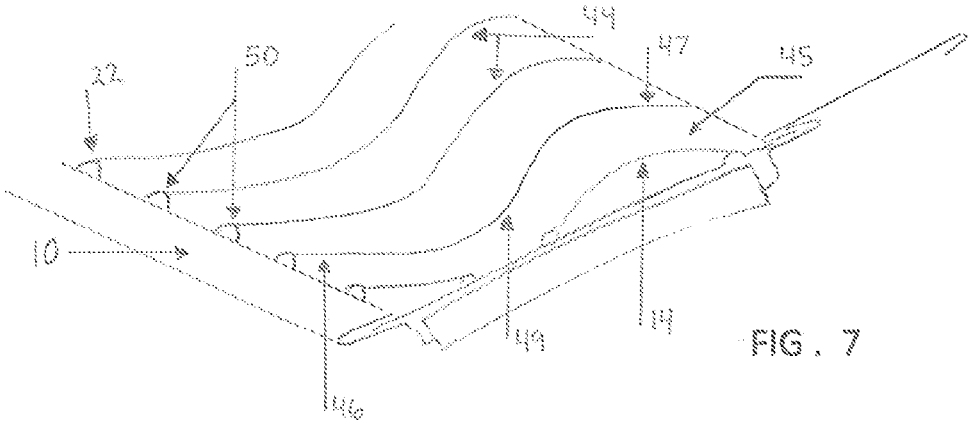
FIG. 7 is a top angle view of the filtering media installed on main body frame of present invention.
Figure 8:
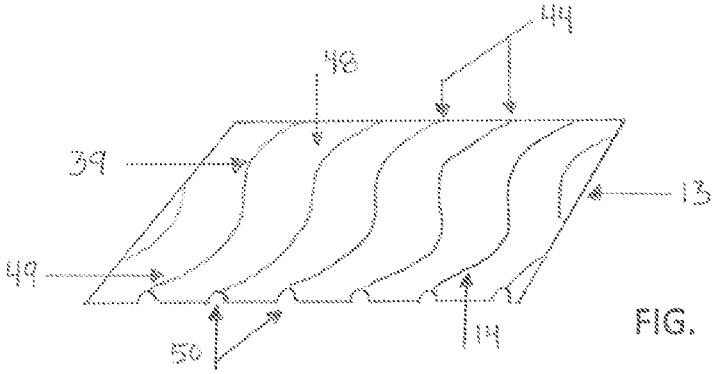
FIG. 8 is the filter media top surface raised ridge surface design of present invention.
Figure 9A:
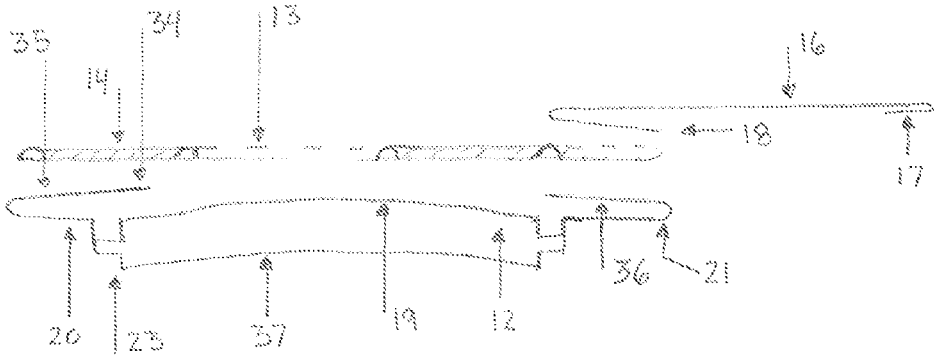
FIG. 9 A is an exploded side view of the present invention.
Figure 9B:
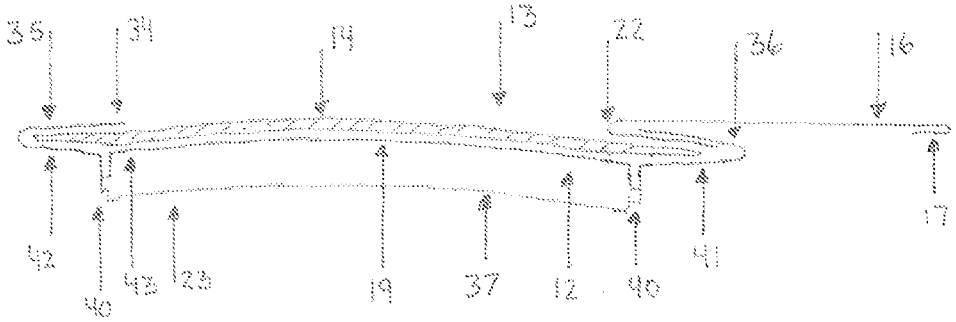
Figure 10:
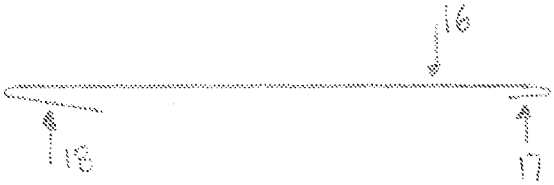
FIG. 10 is a side view of the flat wing design of present invention.
Figure 11:
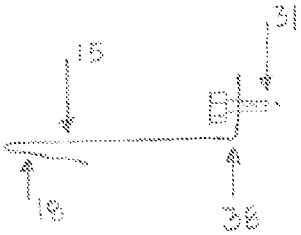
FIG. 11 is a side view of the bend wing design of present invention.

The objects for the present invention for the debris repelling media support system may be accomplished in the following manner: The present invention may have three components consisting of a main body frame (23), a filtering media (13), and one of several different widths rear wing (15)(16) attachments.

The main body frame is configured with a front lip connection plane area (20) for attaching the filtering media (13) and to allow for connection to the gutter surface (29). The frame contains a center recessed curved louver support area that supports the filter media, and the frame has a rear connection plane area (21) for attaching both the filtering media (13) and the rear wing attachment (18). The front lip connection plane area (20) is configured as a flat extended area that is designed to rest upon and attach to the gutter. The filtering media is attached to the front lip connection plane area (20), then the filter media (13) rests upon the top of the curved louvers (19), then the media is attached to the rear filter media connection plane area (36). The design of the attachment shelf that connects the filtering media to the main body connection plan (34) extends slightly over the front connection plane and the puts a slight downward pressure on the filtering media allows for the device to maintain a tight media fit over the entire curved louver support area (12).

In addition, when the rear wing section (16) is attached to rear screen connection plane area (21), the rear wing section extends slightly over the rear connection plane area (20) causing a slight downward pressure on the filtering media which allows for the device to maintain a tight media fit. The upward curved louver design (19) allows for upward force to hold the filtering media (13) in a tight configuration and also repels downward forces on the frame and filtering media. The louver design is a vertical upward curved louver (19) that produces a ridged support frame, having little horizontal surfaces for water to catch upon, and having an unobstructed path for rainwater to flow from the filtering media into the gutter.

The described main body frame (23) on this present invention is made from a one piece design of either folded material or molded material. The curved louvers arise from a supporting shelf that is recessed below the filtering mesh to allow for the louver top edge height (43) to face upward and on the same plane as the both the front (42) and rear (43) media connection plane. The louver (12) is curved upward to produce an arch-like effect on the filtering media with the peak of the curve (19) in the center of the top of the louver. The main body frame (23) is designed to accept a rear wing attachment of different designs and lengths at the rear media connection plane area (36).

The present invention consists of a filtering media (13) component the attaches to the main body frame (23) and is supported underneath by the curved louvers (12). The filtering media's top surface (48) is shaped with many raised ridges (14) that run from front (46) to rear (47) and that have a curved S-shape design (49) in which the ridges are equal distance from each other (50) and also parallel (44) as the S-shape is viewed from side to side (51). The raised ridges (14) have both an angle upward (52) side and a rounded top (53) appearance.

The filtering media is supported by the curved louvers that touches the underneath of the filter media in multiple places. The design of the S-shape pattern (49) on the filter media crosses the vertical louvers in a horizontal-like directions therefore causing a left to right flow of rainwater. The raised ridges' tops (53)(14) are in sufficient height to allow for leafs and debris to be suspended above the filtering media that causes rainwater to flow underneath the debris and into the media. The raised ridges are in close enough proximity to each other to allow for the suspended debris not to interfere with the media filtering of the rainwater. The filtering media rests upon louvers (12) and is attached to the main body (23) at the front (42) and rear (41) connection plan in such a fashion that a slight downward force is placed up the filtering media resulting in a tight fit of the filter media.

The wing sections (15)(16) of the present invention is designed to attach to the main body frame in a permanent connection at the rear connection plane (36) of the main body frame (23). The different size wings allows for the present invention to be installed in multiple ways to the roof fascia (32) or roof deck system (28) that is required to accommodate the many different types of gutters and roofs. The wing can be designed in either a flat wing shape (16) or a bent wing shape (15) where each is attached to the main body in the same manner. The wing's attachment area (18), also described as the front of the wing, is configured to fit over the filtering media (13) and the main body rear connection plane area (36) and be connected in a permanent manner by crimping to the main body frame.

The wing rear area takes the configuration of either flat end (17) for bent end (38) and is used to secure the present invention to the roof system. The flat wing can be of different length from front to rear and contains a folded hem (17) at the rear. The bend wing can be of different length from front to rear and contains an upward bend (38) at the rear.

The present invention when installed on a standard gutter system keeps debris and leafs out of the gutter and allows rainwater (also known as water) to flow inside the gutter without the gutter becoming blocked by the debris. As the rainwater falls, it gets both the roof wet and the present invention's filtering media wet (also known as device) and thereby reducing the surface tension of the filtering media. Rainwater on the roof travels downward toward the gutter and comes in contact with the device, and as the water flows vertically across the filter media the waer goes thought device's filtering media more effectively due to the S-shape raised ridges and through the louvers that don't block or impede water flow.

During this time, the filtering media's raised S-shape media design (49) forces the water flow to break its vertical flow pattern into a non-vertical flow pattern, by directing the water path either in a left or right direction. This non-vertical flow pattern has three purposes, first it slows down the water flow to allow for increase time to allow the water to filter through the media, second it forces the vertical water flow to come in contact with the non-vertical direction side of the raised ridges allowing the forward velocity of the water to assist in drawing the water into the media, and third, by changing the water's vertical direction, the water is drawn across the top of the top of the curved louver supports that are underneath the media, which draws the water into the media. During this third event, the angle of which the water is flowing across the louver support is not perpendicular to the top of the louver, but at a continuous changing angle which increases the water siphoning effect into the filtering media. These three described events work together to achieve an increase flow siphoning effect and water flow through the filtering media during both light rain water flow and heavy rain water flow.

After the water enters the filtering media, it falls directly into the gutter without contacting the horizontal frame support louvers. The louvers act like thin bridges to support the screen and frame, while producing no horizontal surface for water to rest upon or build up on. The lack of a horizontal surface below the filtering media is an important design feature to prevent moss and algae build up. With no horizontal surface under the mesh to retain water, algae and moss growth will be reduced therefore increasing the effectiveness of the device over such current prior art designs which all have substantial horizontal surfaces under the filtering media.

The curved louver design assists in the ridge frame design by using a cantilever (37) approach to resist downward forces on the device. The downward forces put pressure on the device to bend or collapse, mostly by the roof weight resting upon the back of the device or by heavy debris falling on the device. The cantilever louver design (37) resists the downward force and therefore can support a heavier roof system, like Spanish tile or concrete tile, or extreme pressures on the device caused by a high pitched roof system such as 12/12 pitch roof with slate tiles or wood shakes. This resistance by the cantilever effect of the curved louver causes the device's filtering media to remain tight against the main body frame, which is important to not allow the filtering media to loose contact with the underlying frame. Should this occur, the filtering effect of the media is reduced due to the loss of the siphoning effect caused by the underlying frame no longer able to contact the underneath of the filtering media. This bending of frame and subsequent loss of contact between the media and the frame caused by downward forces does not occur in the present invention, but does occur in other such current prior art designs which frames do bend under modest downward force.

The invention claimed is:

1. A debris repelling filtering device to be mounted on top of a gutter opening and to extend from a front to a rear of the gutter opening, the filtering device comprised of a one piece main body frame, a filtering media, and a permanently attached rear mounting wing, of which the main body frame forms supporting louvers in a perpendicular position to a front lip and rear wing of the device, such that the louvers support the filtering media, wherein the main body frame comprises a front mounting lip, a rear wing attachment area, and a center portion of upwardly formed louvers that are vertical to a top and bottom of the main body frame, and where ends of the louvers are perpendicular to the front lip and rear area of the main body frame, wherein the louvers are shaped with a top of the louver edge upward and where the front and rear areas of a louver top edge are on a same horizontal plane as both the front mounting lip and rear mounting wing, and a louver top center edge has an upward curve such that a peak is in a center portion of the louver equal distance from both front and rear louver ends, wherein a louver top edge center portion consists of an upward curve height between 1/32" to 3/4" at a center peak of the louver when measured from the louver's front and rear top edge.

2. A debris repelling filtering device to be mounted on top of a gutter opening and to extend from the front to the rear of the gutter opening, the filtering device comprised of a one piece main body frame, a filtering media, and a permanently attached rear mounting wing, of which the main body frame forms supporting louvers in a perpendicular position to a front lip and rear wing of the device, such that the louvers support the filtering media, wherein the filtering media top surface is shaped in such a manner as to be comprised of a plurality of individual ridges that run from front to rear over the main body frame, wherein each of the individual ridges is in an S-shaped ridge, wherein the S-shaped ridges are in a curved pattern, wherein each S-shaped ridge is adjacent to another S-shaped ridge in the plurality, wherein the curved pattern has a farthest left curve point and a farthest right curve point, wherein the S-shaped curved pattern runs from left to right or right to left as the ridges run from front to rear, wherein a single S-shape ridge has a span distance of between 1/4" to 1.5" from the farthest left curve point to the farthest right curve point wherein the individual S-shaped ridges are spaced an equal distance apart from the adjacent S-shaped ridge, in which the ridges remain in a parallel arrangement of between 1/4" to 1.5".

* * * * *